US008069596B2

(12) United States Patent
Maier-Hunke

(10) Patent No.: US 8,069,596 B2
(45) Date of Patent: Dec. 6, 2011

(54) STAND FOR AN INFORMATION PANEL

(75) Inventor: Horst-Werner Maier-Hunke, Iserlohn (DE)

(73) Assignee: "Durable" Hunke & Jochheim GmbH & Co. KG, Iserlohn (DE)

( * ) Notice: Subject to any disclaimer, the term of this patent is extended or adjusted under 35 U.S.C. 154(b) by 250 days.

(21) Appl. No.: 12/085,622

(22) PCT Filed: Nov. 25, 2006

(86) PCT No.: PCT/EP2006/011313

§ 371 (c)(1),
(2), (4) Date: Aug. 24, 2009

(87) PCT Pub. No.: WO2007/062786

PCT Pub. Date: Jun. 7, 2007

(65) Prior Publication Data

US 2010/0024267 A1 Feb. 4, 2010

(30) Foreign Application Priority Data

Nov. 29, 2005 (DE) ..... 10 2005 058 123

(51) Int. Cl.

| | |
|---|---|
| ***G09F 11/02*** | (2006.01) |
| ***G09F 15/02*** | (2006.01) |
| ***G09F 15/00*** | (2006.01) |
| ***E05C 5/04*** | (2006.01) |
| ***E05C 5/02*** | (2006.01) |
| ***E05C 19/00*** | (2006.01) |

(52) U.S. Cl. ..... 40/493; 40/503; 40/504; 40/505; 40/506; 40/473; 40/606.14; 40/606.15; 40/607.1; 292/58; 292/59; 292/61; 292/1; 292/300

(58) Field of Classification Search ..... 40/493, 40/503, 504, 505, 506, 473, 606.14, 606.15, 40/607.1; 292/58, 59, 61, 1, 300
See application file for complete search history.

(56) References Cited

U.S. PATENT DOCUMENTS

| | | | | | |
|---|---|---|---|---|---|
| 1,374,471 | A | * | 4/1921 | Reynard | 40/606.15 |
| 2,073,403 | A | * | 3/1937 | Goldberg | |
| 3,221,429 | A | * | 12/1965 | Reuben et al. | 40/658 |
| 2008/0209780 | A1 | * | 9/2008 | Gibbs | 40/473 |

FOREIGN PATENT DOCUMENTS

| | | | |
|---|---|---|---|
| DE | 33 04 180 | A1 | 8/1984 |
| DE | 299 21 990 | U1 | 2/2000 |
| DE | 199 13 865 | A1 | 9/2000 |
| DE | 20 2004 001827 | * | 4/2004 |
| JP | 2000 181353 | * | 6/2000 |
| WO | WO 2005/073942 | A2 | 8/2005 |

* cited by examiner

*Primary Examiner* — Joanne Silbermann
*Assistant Examiner* — Syed A Islam
(74) *Attorney, Agent, or Firm* — Mark P. Stone

(57) ABSTRACT

In the case of a stand for an information sign (2), the support (1) used for the information sign (2) is an L-shaped metal strip which is releasably connected to a base part, ensuring the stability of the stand, and, at its top end, has a pivot pin (14) and coupling discs (22, 23) which are provided with locking protrusions (20) and locking recesses (21), by means of which the information sign (2) can be arrested in different positions.

13 Claims, 6 Drawing Sheets

STAND FOR AN INFORMATION PANEL

TECHNICAL FIELD

The present invention refers to a stand for an information sign comprising a base part and a support which is releasably connected to the base part and which at its end facing away from the base part carries the information sign.

PRIOR ART

A stand of the above-mentioned kind is known from DE 94 02 735 U1. It consists of a base part and a support which is configured as a tube and whose upper end has arranged thereon an information sign assuming a predetermined position.

Moreover, FIG. 3 of DE 33 04 180 A1 discloses a data and information board for workplaces, which only consists of two parts and in the case of which the support for the data and information board is formed by a substantially L-shaped metal strip whose lower end forms a base to be placed on a table and whose upper end has rotatably supported thereon the data and information board. To ensure a safe stand for the known data board on a table, the folded lower end of the metal strip is secured by means of a double adhesive film to the worktable.

A rotatable support of a sign on a holder is also shown in US 2 073 403 A. In this case the sign can be arrested in three different positions. To be able to change the position of the sign, said sign is provided with six bores for a pair of screw bolts guided in a longitudinal slit of the holder.

ILLUSTRATION OF THE INVENTION

It is the object of the present invention to provide a stand of the type in question in the case of which the position of the information sign can be changed rapidly and comfortably. This object is achieved according to the invention in that the support formed by a substantially L-shaped metal strip and the information sign connected to said support via a pivot pin have arranged thereinbetween two coupling discs which are pressed against each other by a spring and which comprise locking protrusions and locking recesses by which the information sign can be arrested in different positions.

The stand according to the invention enables its user to transfer the information sign in an easy way into different defined positions and to adapt it in this way to the conditions given by the respective pieces of information, i.e. for instance a long designation in a landscape or transverse format or a short name in an upright format.

Further features and details of the present invention result from the sub-claims and the subsequent description of a stand illustrated in the enclosed drawings.

BRIEF DESCRIPTION OF THE DRAWINGS

The following are shown.

WAYS OF CARRYING OUT THE INVENTION

Figure 1:
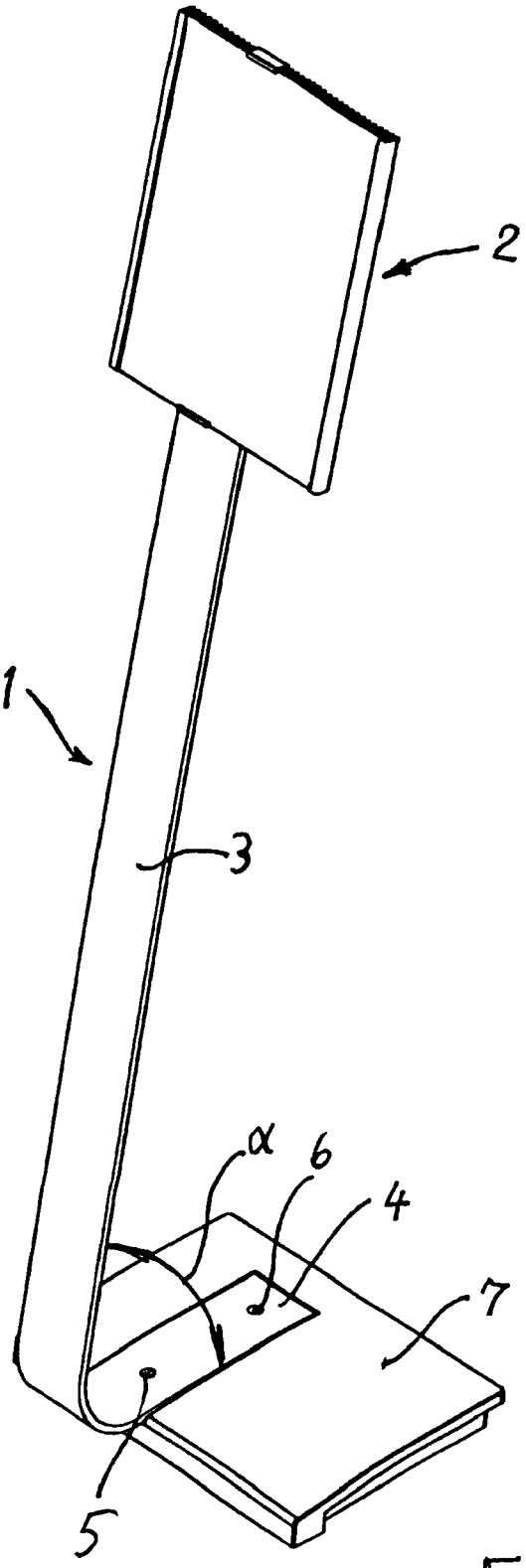
FIG. 1 a perspective front view of a stand with an information sign arranged in an upright format.
Figure 2:
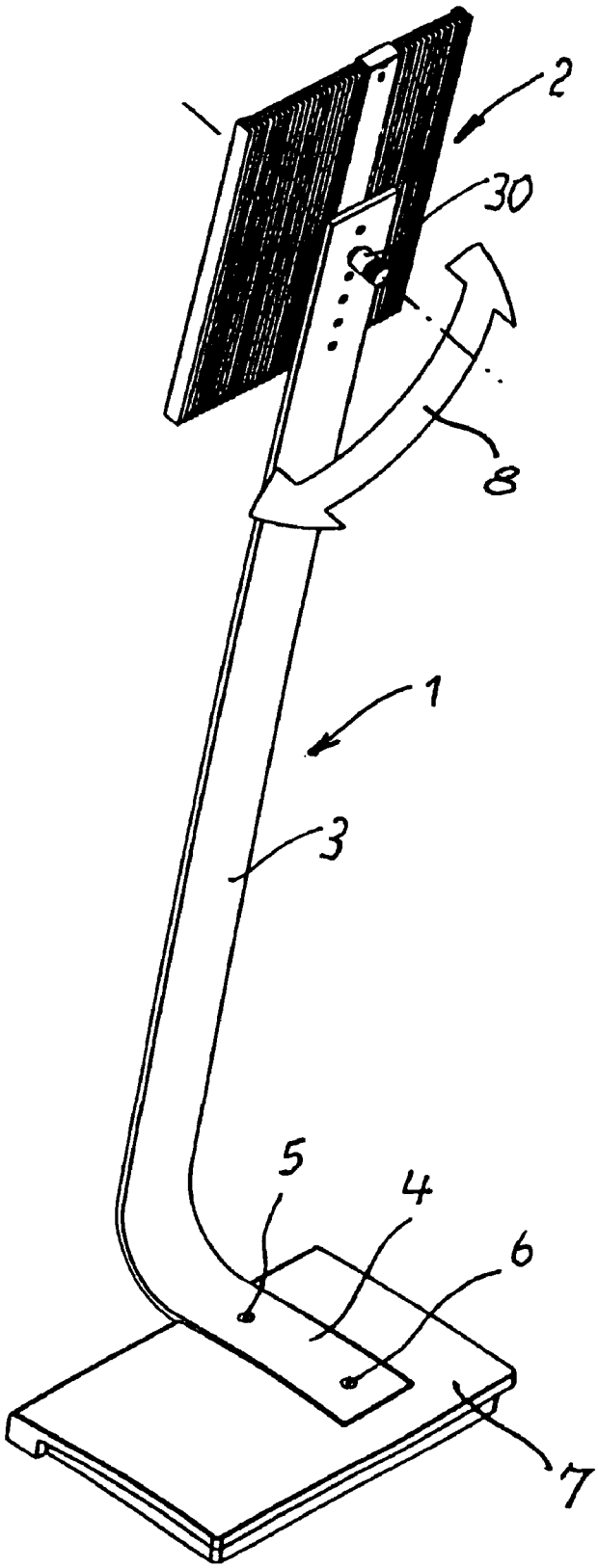
FIG. 2 a rear view of the stand according to FIG. 1.
Figure 3:
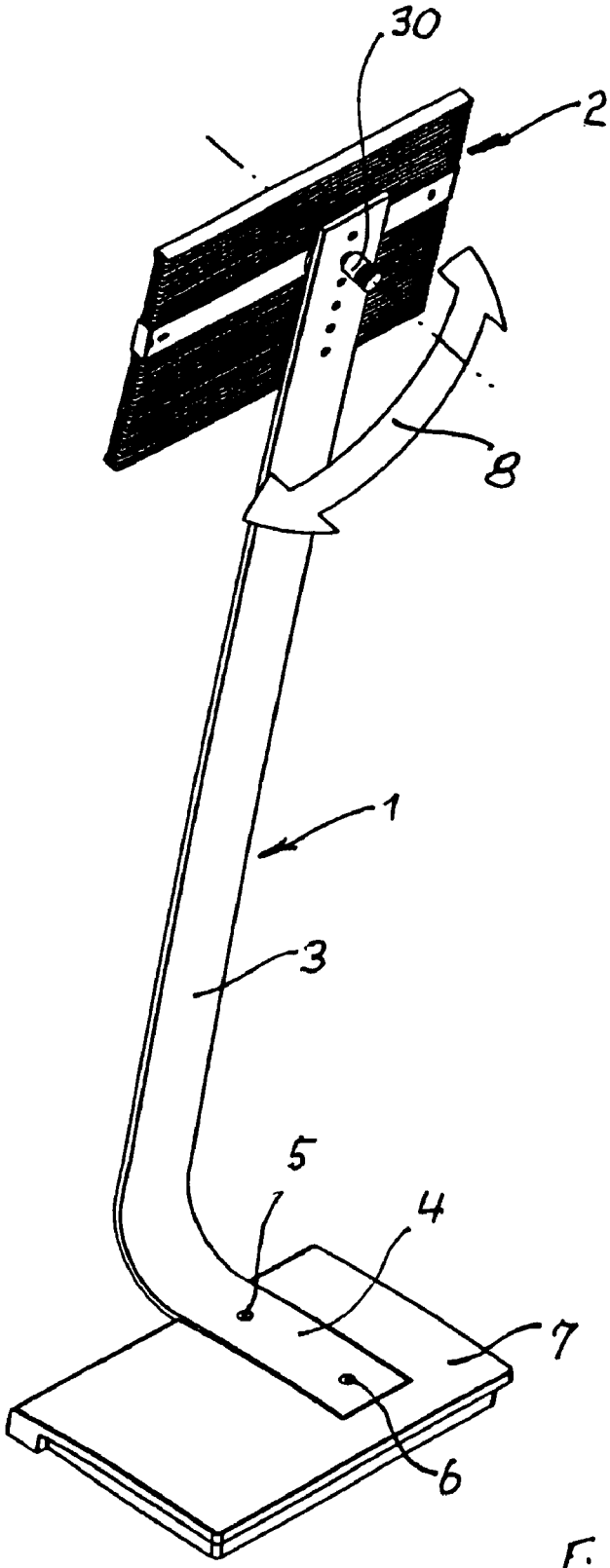
FIG. 3 a rear view of the stand according to FIG. 1 after the information sign has been rotated by 90°.

In FIGS. 1 to 3, reference numeral 1 designates a support which consists of a flat aluminum strip for an information sign 2, which is arranged at its upper end and also consists of aluminum. The support 1 is substantially shaped in the form of an L, the long and short legs 3 and 4 of which assume an angle $\alpha$ with each other that is smaller than 90°. The short leg 4 of the support is secured by means of two screws 5 and 6 in a recess of a base part 7 consisting of gray cast iron for reasons of stability.

In FIGS. 2 and 3, arrow 8 illustrates how the information sign 2 can be transferred from an upright position into a transverse position and back again.

Figure 4:
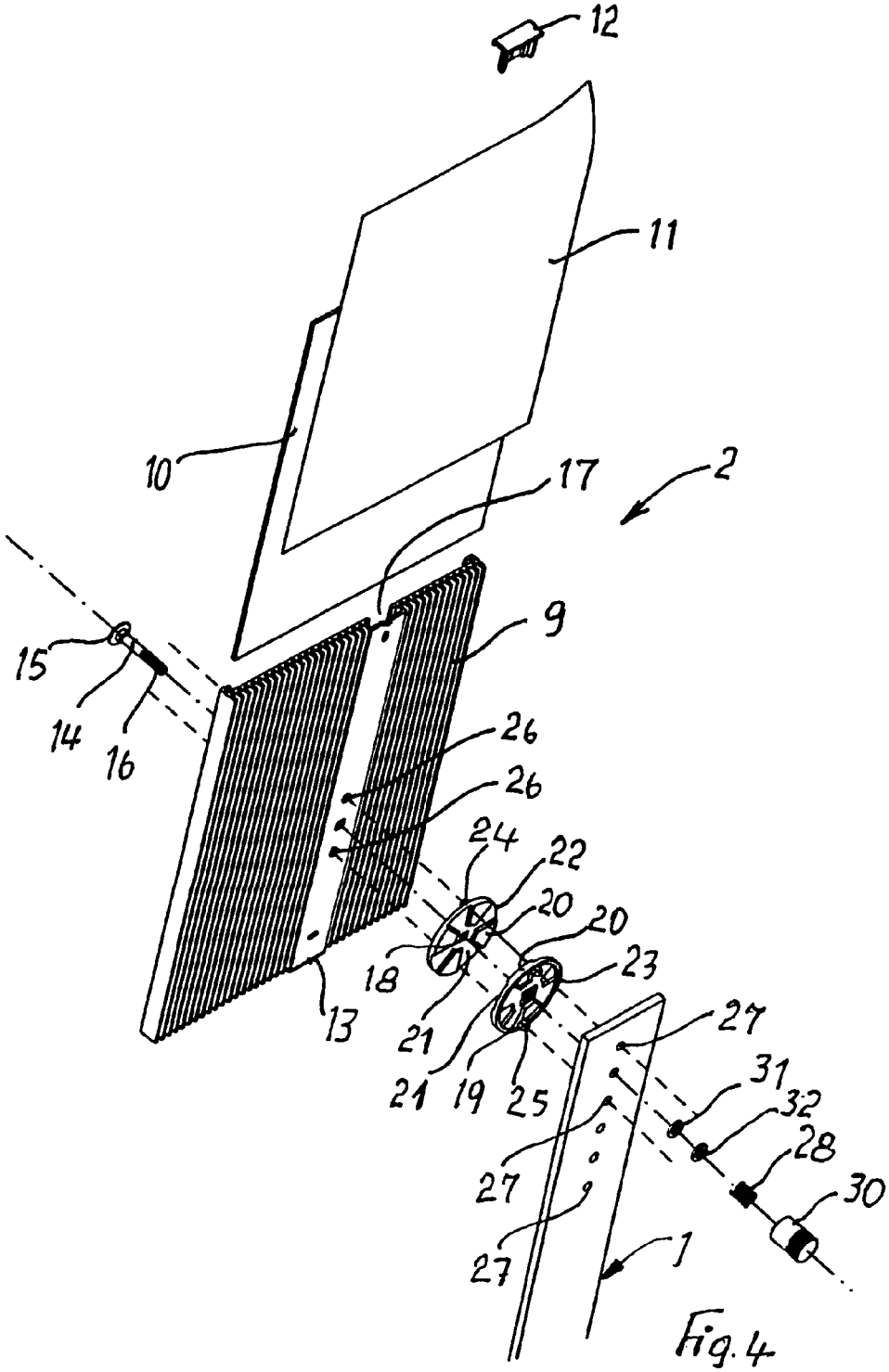
FIG. 4 an exploded view showing the means used for securing the information sign to the support.

The information sign 2 is a sign which consists of a basic body 9 and a cover panel 10 which is releasably connected to the basic body 9 for an information carrier 11 that can be accommodated between the basic body 9 and the cover panel 10, and of means (12, 13) for keeping the three aforementioned parts together (cf. FIG. 4). A sign of this type is known from DE 20 2004 001 827 U1.

A pivot pin 14 that is provided at its one end with a head 15 and at its other end with a thread 16 serves to fasten the information sign 2 to the support 1. The head 15 of the pivot pin 14 fits into a recess 17 of the information sign 2 which is formed by a groove.

Two coupling discs 22 and 23 provided with bores 18, 19 for the pivot pin 14 and with locking protrusions 20 and locking recesses 21 are arranged between the information sign 2 and the support 1. At their sides facing away from the locking protrusions 20 and locking recesses 21 the coupling discs 22, 23 further comprise locking cams 24 and 25, respectively, which fit into locking holes 26 of the information sign 2 and into bores 27 useable as locking holes at the upper end of the support 1. The diameters of the bores 27 are large enough to accommodate not only the locking cams 24, but also the pivot pin 14.

Figure 5:
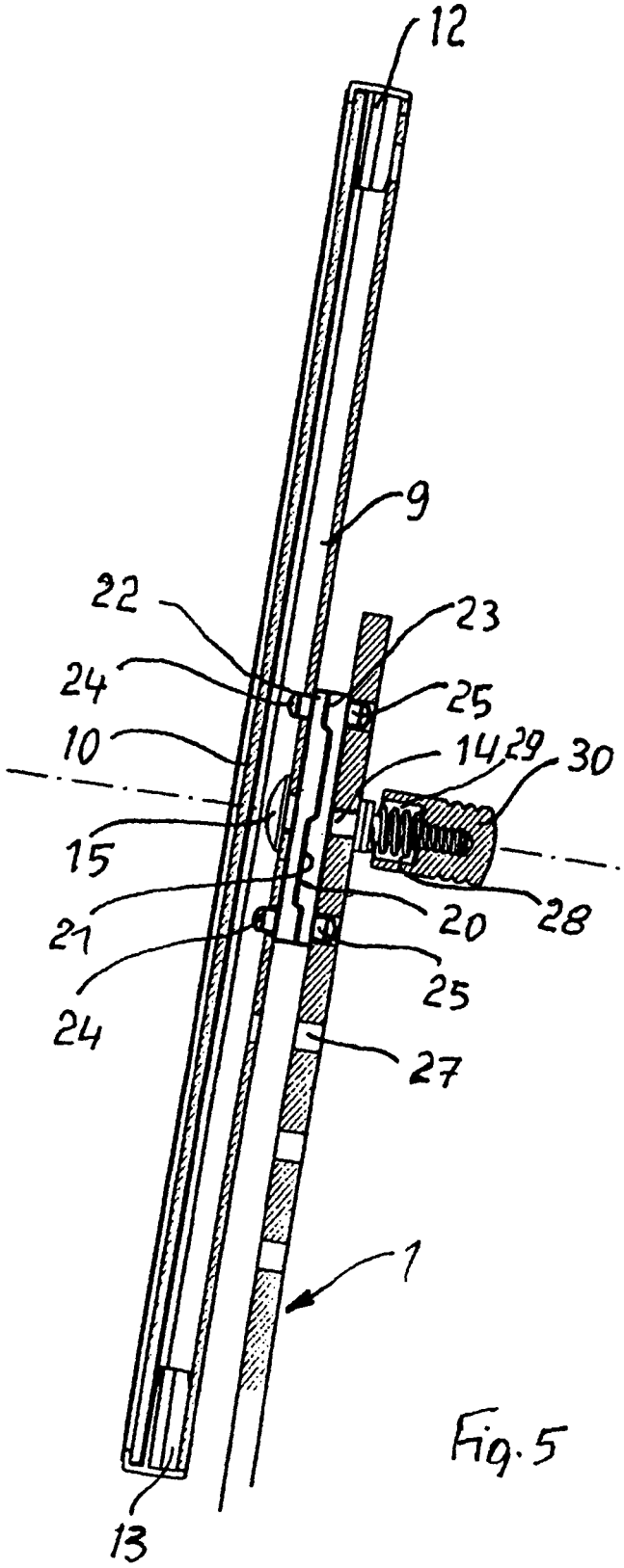
FIG. 5 a section taken through the information sign and the support in the position of the information sign as shown in FIG. 1 and FIG. 6 a section corresponding to FIG. 5 in an intermediate position assumed by the information sign during transfer from the position according to FIG. 1 into the position according to FIG. 3.
Figure 6:
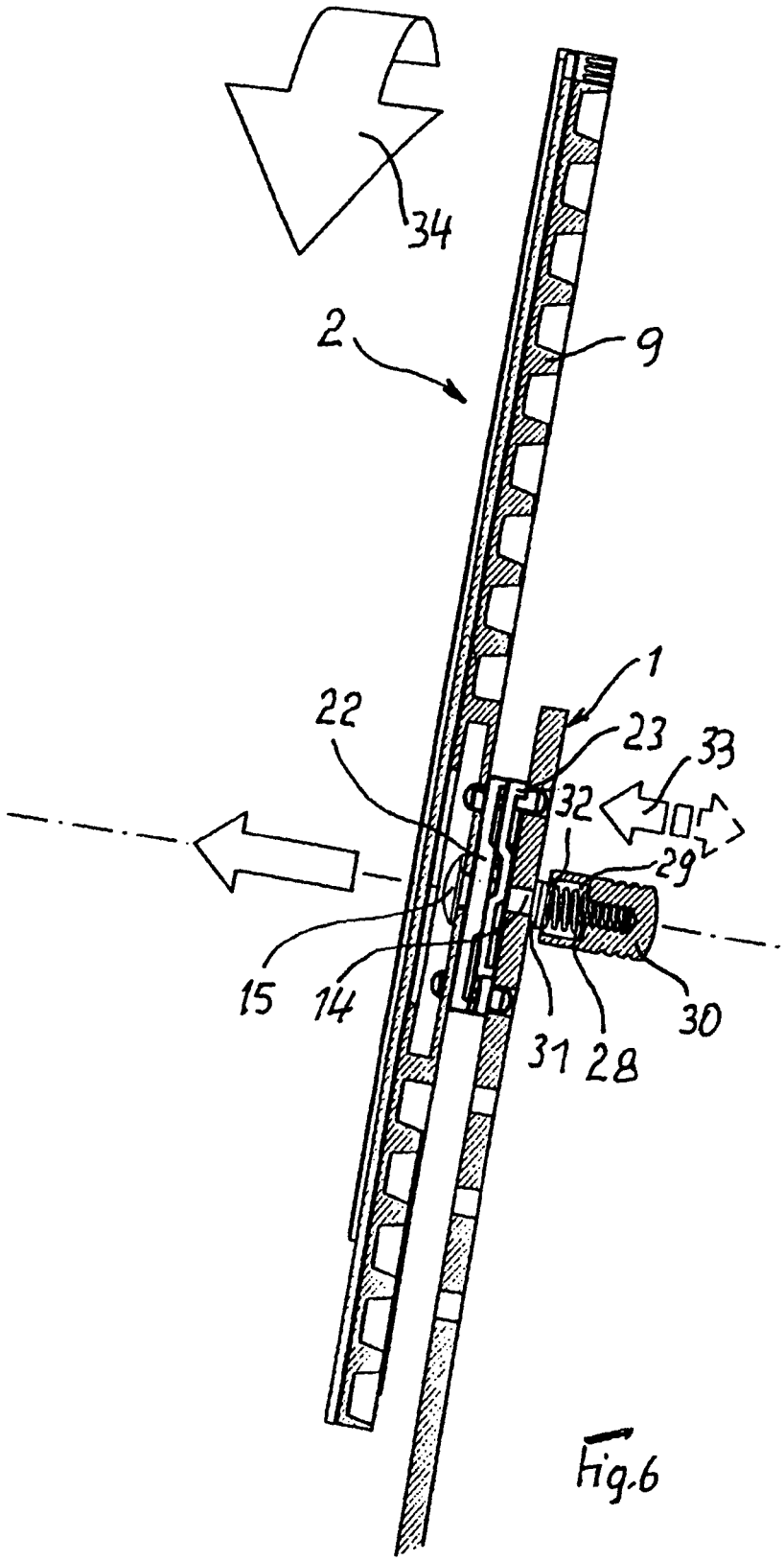

The coupling discs 22, 23, which are non-rotatably connected to the information sign 2 and the support 1, are held together by a spring 28 whose one end is supported in a chamber 29 of an actuating button 30 configured in the manner of a cap nut and whose other end is supported on the back side of the support 1 via two washers 31 and 32, of which one is made of plastics. The spring 28 is configured as a pressure spring and holds the coupling discs 22, 23 normally in the position shown in FIG. 5. When the user wishes to pivot the information sign 2 by 90°, he will press the cap nut 30 in the direction of arrow 33 in FIG. 6 and initiate a rotational movement in the direction of arrow 34 to the information sign 2. Due to the inclined side walls of the locking protrusions 20 and the locking recesses 21, the coupling discs 22, 23 will move away from each other until the rotational movement is completed and the external pressure acting on the actuating button 30 and the spring 28 is no longer maintained.

The invention claimed is:

1. A stand for an information sign comprising a base part (7) and a support (1) which is releasably connected to the base part (7)and which at its end facing away from the base part (7) carries the information sign, wherein that the support (1) formed by a substantially L-shaped metal strip and the information sign (2) connected to said support via a pivot pin (14) have arranged thereinbetween two coupling discs (23, 23)

which are pressed against each other by a spring (28) and which comprise locking protrusions (20) and locking recesses (21) by which the information sign (2) can be arrested in different positions, and wherein the one coupling disc (22) is non-rotatable connected to the Information sign (2) and the other coupling disc (23) is non-rotatable connected to the support (1), characterized in that locking cams (24, 25) which project beyond the back sides of the coupling discs (22, 23) and which have assigned thereto locking holes (26, 27) in the information sign (2) and in the support (1) serve to establish the non-rotatable connection between the coupling discs (22, 23) and the information sign (2) as well as the support (1).

2. The stand according to claim 1, characterized in that one end of the spring (28) that serves to press the coupling discs (22, 23) against each other is supported in a chamber (29) of an actuating button (30) which is screwed onto a thread (16) of the pivot pin (14) projecting beyond the back side of the support (1).

3. The stand according to claim 2, characterized in that the spring (28) formed as a pressure spring holds the actuating button (30) in the engaged condition of the coupling discs (22, 23) at a distance away from the back side of the support (1) that is greater than the height of the locking protrusions (20) of the coupling discs (22, 23).

4. The stand according to claim 3, characterized in that the support (1) is provided at its top end with a number of bores (27) suited for accommodating the pivot pin (14).

5. The stand according to claim 3, characterized in that the pivot pin (14) is non-rotatably connected to the information sign (2).

6. The stand according to claim 2, characterized in that the support (1) is provided at its top end with a number of bores (27) suited for accommodating the pivot pin (14).

7. The stand according to claim 2, characterized in that the pivot pin (14) is non-rotatably connected to the information sign (2).

8. The stand according to claim 2, characterized in the information sign (2) is provided at its front side with a recess (17) for accommodating the head (15) of the pivot pin (14).

9. The stand according to claim 2, characterized in that the support (1) and the information sign (2) are made of light metal whereas the base part (2) is configured as a gray cast iron part.

10. The stand according to claim 1, characterized in that the support (1) is provided at its top end with a number of bores (27) suited for accommodating the pivot pin (14).

11. The stand according to claim 1, characterized in that the information sign (2) is provided at its front side with a recess (17) for accommodating the head (15) of the pivot pin (14).

12. The stand according to claim 1, characterized in that the support (1) and the information sign (2) are made of light metal whereas the base part (2) is configured as a gray cast iron part.

13. The stand according to claim 1, characterized in that the pivot pin (14) is non-rotatably connected to the information sign (2).

* * * * *